US008225860B2

(12) United States Patent
Hradecky

(10) Patent No.: US 8,225,860 B2
(45) **Date of Patent: *Jul. 24, 2012**

(54) DOWNHOLE JARRING TOOL WITH REDUCED WEAR LATCH

(75) Inventor: Jason A. Hradecky, The Woodlands, TX (US)

(73) Assignee: Impact Selector, Inc., Rockwall, TX (US)

( * ) Notice: Subject to any disclaimer, the term of this patent is extended or adjusted under 35 U.S.C. 154(b) by 295 days.

This patent is subject to a terminal disclaimer.

(21) Appl. No.: 12/647,840

(22) Filed: Dec. 28, 2009

(65) Prior Publication Data

US 2011/0132598 A1 Jun. 9, 2011

Related U.S. Application Data

(63) Continuation-in-part of application No. 12/632,411, filed on Dec. 7, 2009, now Pat. No. 8,191,626.

(51) Int. Cl.
*E21B 31/107* (2006.01)
*E21B 23/00* (2006.01)

(52) U.S. Cl. ..... 166/178; 166/301; 166/381

(58) Field of Classification Search ..... 166/178, 166/301, 381, 65.1; 285/145.1, 145.4, 302, 285/316, 317, 922; 294/86.12
See application file for complete search history.

(56) References Cited

U.S. PATENT DOCUMENTS 4,076,086 A 2/1978 Evans
4,566,546 A 1/1986 Evans
4,646,830 A * 3/1987 Templeton ..... 166/178
4,805,699 A * 2/1989 Halbardier ..... 166/387
4,844,183 A 7/1989 Evans
5,086,853 A 2/1992 Evans
5,103,903 A 4/1992 Marks, II
5,156,211 A 10/1992 Wyatt
5,212,354 A 5/1993 Miller et al.
5,318,139 A 6/1994 Evans
5,503,228 A 4/1996 Anderson
5,507,347 A 4/1996 Estilette, Sr.
5,624,001 A 4/1997 Evans
5,810,087 A 9/1998 Patel
5,826,660 A 10/1998 Rytlewski
5,875,842 A 3/1999 Wyatt
6,244,351 B1 6/2001 Patel et al.
6,290,004 B1 9/2001 Evans
6,321,848 B1 11/2001 Funk
6,349,771 B1 2/2002 Luke
6,481,495 B1 11/2002 Evans
6,604,582 B2 8/2003 Flowers et al.
6,640,894 B2 11/2003 Bloom et al.
6,866,096 B2 3/2005 Tillett, Jr.
6,896,060 B2 5/2005 Tillett, Jr.
(Continued)

*Primary Examiner* — Daniel P Stephenson
*Assistant Examiner* — Catherine Loikith
(74) *Attorney, Agent, or Firm* — Fellers, Snider, Blankenship, Bailey & Tippens, P.C.

(57) ABSTRACT

A jarring tool having an extensible joint connecting first and second sub ends. A first inner latch piece connects to the upper sub end, and a second outer latch piece connects to the lower sub end. The joint, in a latched position, has the outer latch piece latched to the inner latch piece and the inner and outer latch pieces restrained from unlatching by a stationary restraining collar. Under tensile force the joint unlatches into an unlatched position by the outer latch piece pulling the inner latch piece through the restraining collar into a position where the inner and outer latch pieces are free to separate. An impact force is generated from the tensile force when the joint unlatches and reaches a maximum extension.

20 Claims, 9 Drawing Sheets

U.S. PATENT DOCUMENTS

| | | | | |
|---|---|---|---|---|
| 6,988,551 | B2 | 1/2006 | Evans | |
| 7,111,678 | B2 * | 9/2006 | McElroy et al. | 166/178 |
| 7,267,176 | B2 | 9/2007 | Madden | |
| 7,281,575 | B2 | 10/2007 | McElroy et al. | |
| 7,290,604 | B2 | 11/2007 | Evans | |
| 7,303,020 | B2 | 12/2007 | Bishop et al. | |
| 7,311,149 | B2 | 12/2007 | Evans | |
| 7,367,397 | B2 | 5/2008 | Clemens et al. | |
| 7,373,974 | B2 | 5/2008 | Connell et al. | |
| 7,424,910 | B2 | 9/2008 | Xu et al. | |
| 7,533,724 | B2 | 5/2009 | McLaughlin | |
| 7,559,361 | B2 | 7/2009 | Obrejanu | |
| 7,591,319 | B2 | 9/2009 | Xu | |
| 7,669,661 | B2 | 3/2010 | Johnson | |
| 7,775,280 | B2 | 8/2010 | Rose | |
| 2007/0151732 | A1 | 7/2007 | Clemens et al. | |

* cited by examiner

DOWNHOLE JARRING TOOL WITH REDUCED WEAR LATCH

CROSS REFERENCE TO RELATED APPLICATIONS

This application is a continuation-in-part application of U.S. patent application Ser. No. 12/632,411 entitled "DOWNHOLE JARRING TOOL," filed Dec. 7, 2009, the contents of which are hereby incorporated by reference.

FIELD OF THE INVENTION

This disclosure relates to downhole tools in general and, more specifically, to impact jars for freeing stuck tools.

BACKGROUND OF THE INVENTION

Drilling operations have become increasingly expensive as the need to drill in harsher environments, through more difficult materials, and deeper than ever before have become reality. Additionally, more testing and evaluation of completed and partially finished well bores has become a reality in order to make sure the well produces an acceptable return on investment.

In working with more complex and deeper well bores, a greater danger arises that work strings and tools will be stuck within the bore. In addition to the potential to damage equipment in trying to retrieve it, the operation of the well must generally stop while tools are fished from the bore. Moreover, with some fishing techniques, it is possible to damage the well bore itself.

Any tool designed for use in a downhole environment may be subject to heat, pressure, and unclean operating conditions. Internal components may be subject to repeated stresses that must be overcome in order to function reliably, and for a suitable length of time, to warrant inclusion in the work string. Additionally, economies may be realized by constructing a tool that is wear resistant enough to be used for a lengthy periods of time before breakdowns or rebuilds.

What is needed is a device for addressing the above and related concerns.

SUMMARY OF THE INVENTION

The invention of the present disclosure, in one aspect thereof comprising a jarring tool having an extensible joint connecting first and second sub ends. The joint comprises a first inner latch piece connected to the upper sub end, second outer latch piece connected to the lower sub end, and a stationary restraining collar. The joint, in a latched position, has the outer latch piece latched to the inner latch piece and the inner and outer latch piece restrained from unlatching by the restraining collar. Under tensile force, the joint unlatches into an unlatched position by the outer latch piece pulling the inner latch piece through the restraining collar into a position where the inner and outer latch pieces are free to separate. An impact force is generated from the tensile force when the joint unlatches and reaches a maximum extension.

In some embodiments, the joint relatches into a latched position by the outer latch piece pushing the inner latch piece back through the restraining collar into a position where the inner and outer latch pieces are free to relatch.

The outer latch piece may comprises a collet device that may have a plurality of fingers with nubs along distal ends that contact a lip on the inner latch piece when being moved into the latched or unlatch positions through the restraining collar. The collet may be biased toward the inner latch piece by a coil spring.

In some embodiments, the tool includes a lower shaft interconnecting the inner latch piece to the lower sub end, and a lower stop slidably receiving the lower shaft. The impact force at maximum extension results from contact between the lower shaft and the lower stop. The tool may also include an upper sub housing connected to the upper sub end, a lower sub housing, a center connector connecting the upper sub housing and the lower sub housing, an upper shaft slidably received through the center connector and connecting to the upper latch piece, and a plurality of springs biasing the upper shaft away from the center connector. The restraining collar may attached in a fixed relationship to the lower sub housing. The plurality of springs may comprise a plurality of spring washers. A coil spring may abut the plurality of spring washers and a spring cage may partially surround the coil spring.

In some embodiments, a central passage is defined through the extensible joint and through the upper and lower sub ends. An electrical conductor may be carried within the central passage.

DETAILED DESCRIPTION OF THE PREFERRED EMBODIMENTS

Figure 1A:
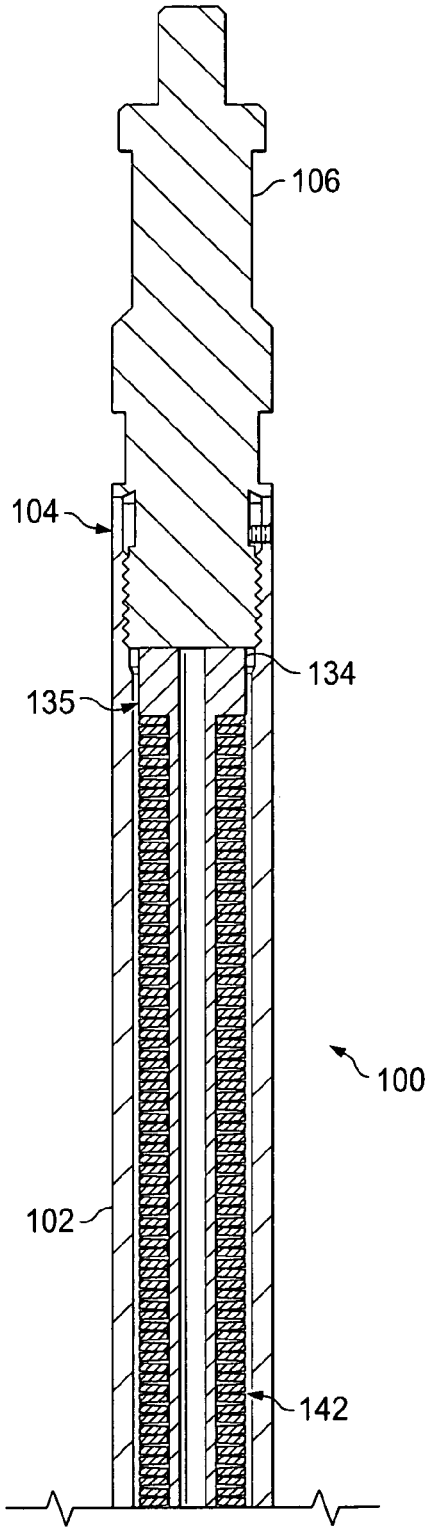
FIGS. 1A-1D taken together provide a side cutaway view of one embodiment of the jarring tool of the present disclosure.
Figure 1B:
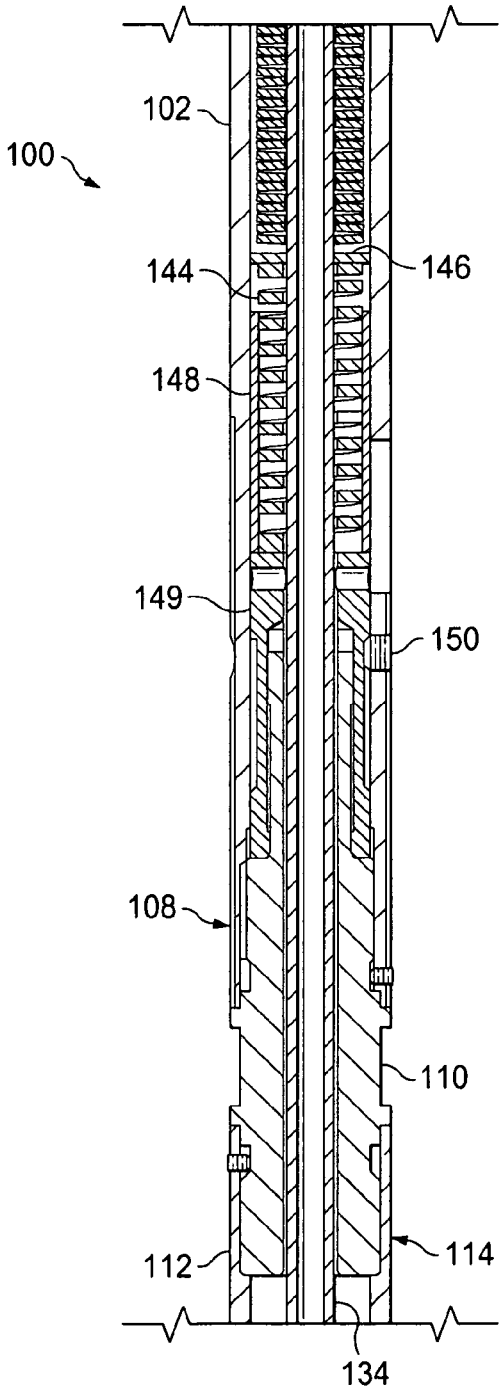
Figure 1C:
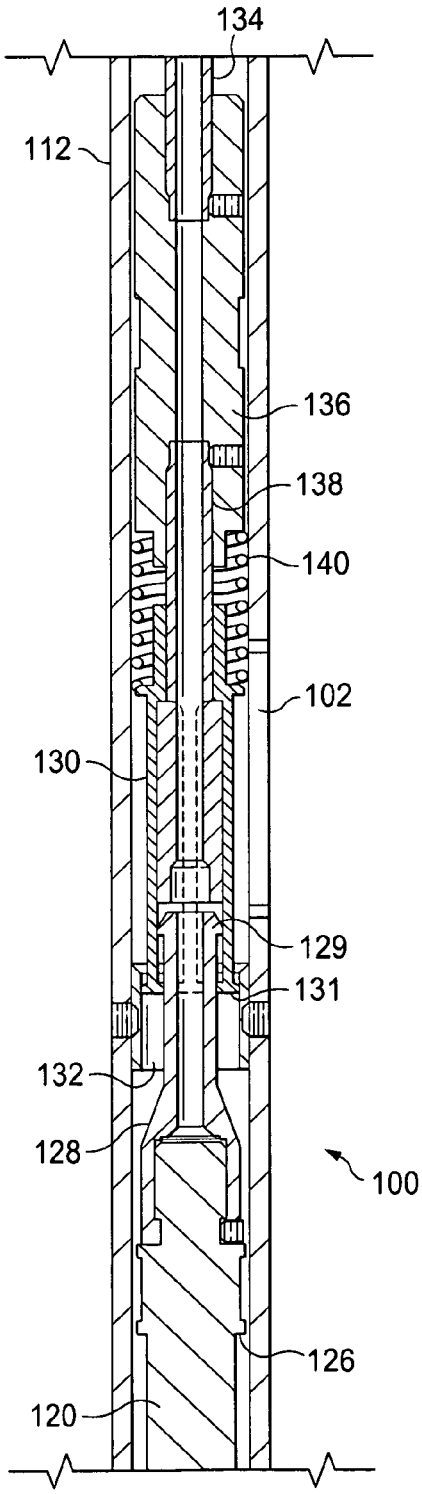
Figure 1D:
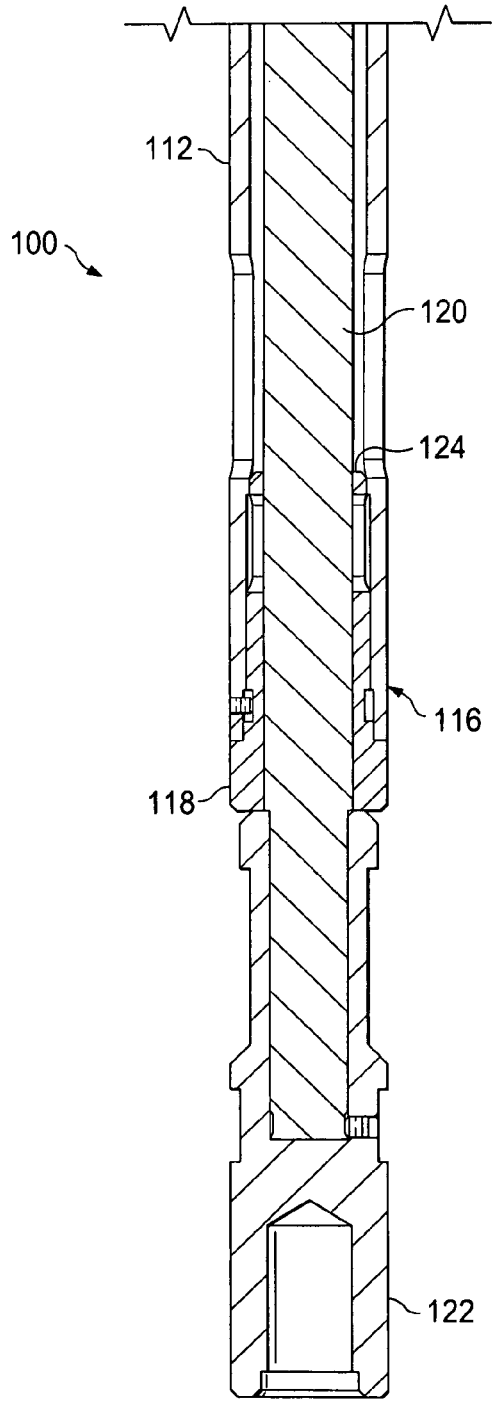
Figure 2A:
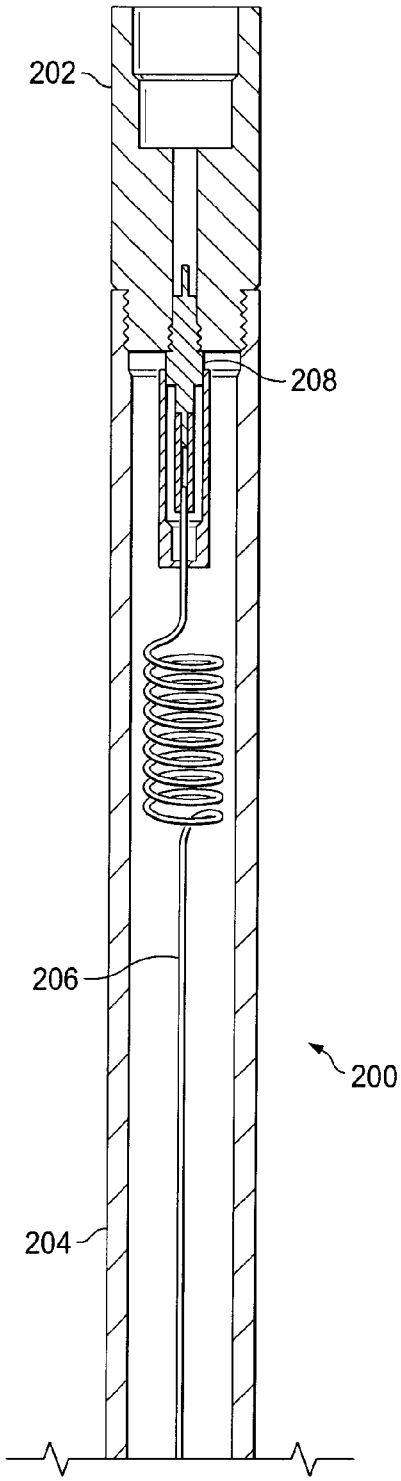
FIGS. 2A-2E taken together provide a side cutaway view of another embodiment of the jarring tool of the present disclosure.
Figure 2B:
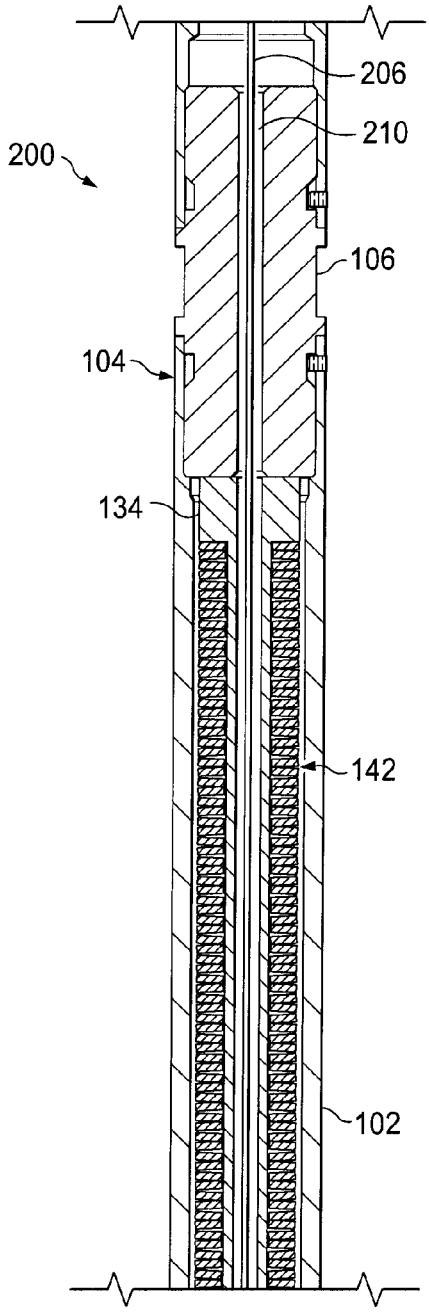
Figure 2C:
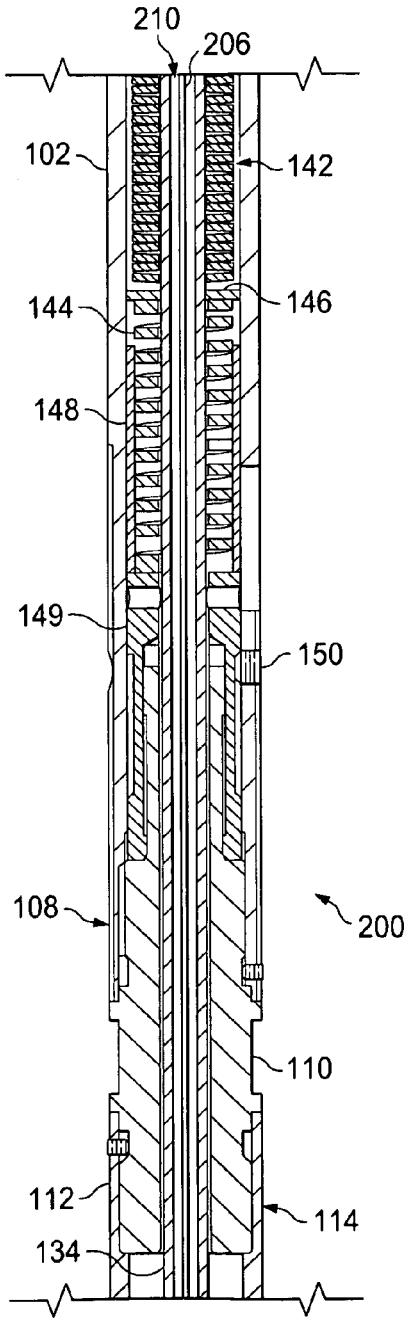
Figure 2D:
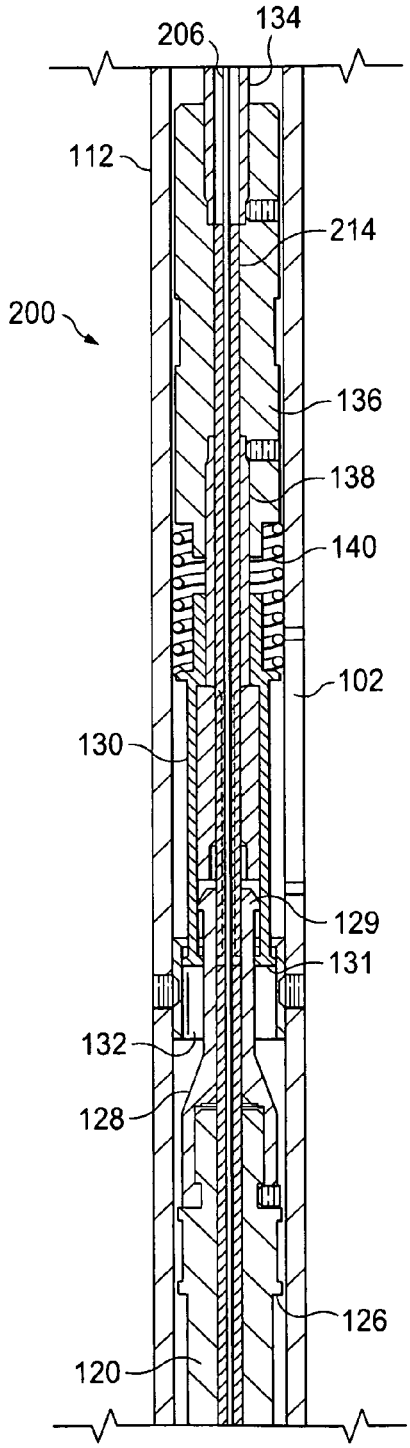
Figure 2E:
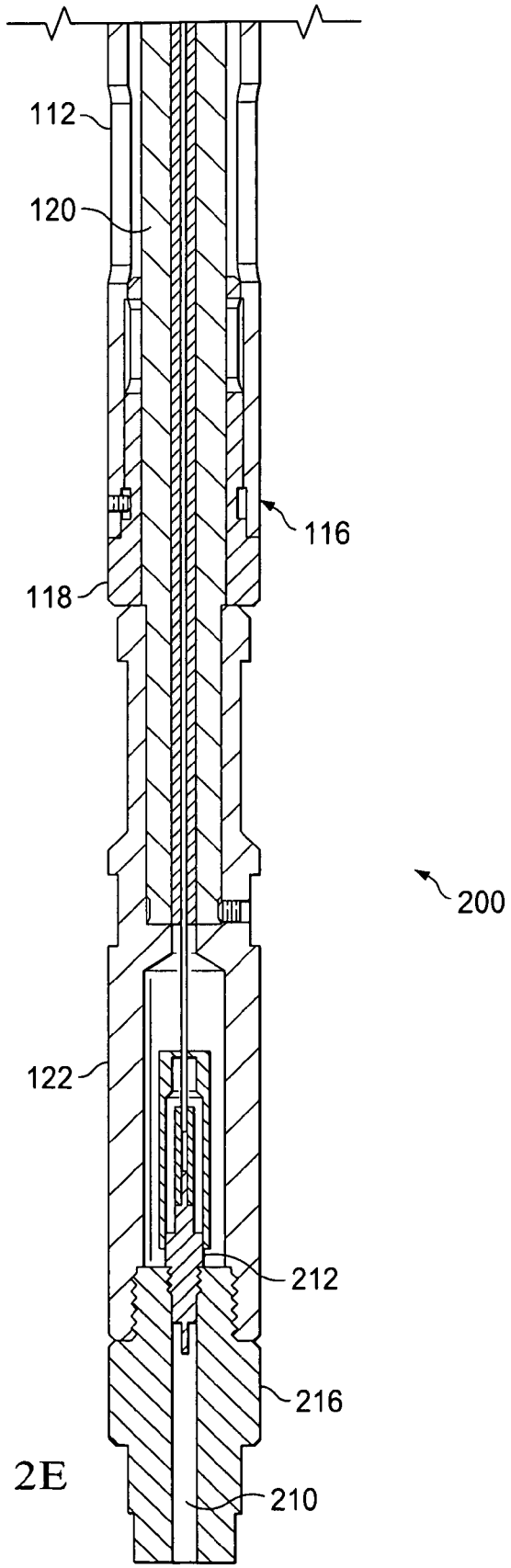

Referring now to FIGS. 1A-1D, a side cutaway view of one embodiment of a downhole jarring tool according to aspects of the present disclosure is shown. These drawings are meant to be understood sequentially as adjoining segments of a jarring tool 100. FIG. 1A illustrates the uppermost end of the tool 100, which is to be followed by FIG. 1B, FIG. 1C, and FIG. 1D. In the present embodiment, FIG. 1D illustrates the bottom most portion of the jarring tool 100. In the present embodiment, the jarring tool 100 includes an upper sub housing 102 having a distal end 104 attached to an upper sub end 106. A proximal end 108 of the upper sub housing 102 interconnects with a center connector 110. The center connector 110 joins the upper sub housing 102 with a lower sub housing 112. A proximal end 114 of the lower housing 112 connects to the center connector 110.

A distal end 116 of the lower housing 112 is connected to a lower stop 118. In the present embodiment, the lower stop 118 provides for sliding engagement and limited passage of the lower shaft 120. The lower shaft 120 may be interconnected to a lower sub end 122. The range of motion of the lower shaft 120 relative to the lower housing 112 may be limited by both the lower sub end 122 and by an inner shoulder 124 of the lower stop 118. The lower shaft 120 provides a shoulder 126, which will be too wide to pass through the lower stop 118. As will be described in greater detail below, when the jarring tool 100 is activated, the upper sub end 106 will extend away from the lower sub end 122 to the point where inner shoulder 124 of the lower stop 118 contacts the lower shaft shoulder 126.

The lower shaft 120 connects to an inner latch piece 128. The inner latch piece 128 interfits with an outer latch piece 130. In the present embodiment, the outer latch piece 130 is a collet device. In order to secure adequate transmission of tensile forces between the inner latch piece 128 and the outer latch piece 130, the inner latch piece 128 may have a lip 129 extending substantially around a proximal end of the latch piece 128. Similarly, outer latch piece 130 may have a lip 131 on one or more of the collet fingers of the latch piece. Additionally, a release sleeve 132, which restricts the diameter to which the outer latch 130 may open, may be placed in an appropriate fixed location within the lower sub housing 112.

The upper latch piece 130 may be connected to an upper shaft 134. In the present embodiment, there may be a number of interposing parts, such as a latch connector 136, an outer latch connector 138, and a bias spring 140. The full function of the additional parts will be explained in greater detail below. However, from the present description, it can be appreciated that the latch connector 136 and outer latch connector 138 serve generally to interconnect the upper shaft 134 to the outer latch piece 130. The outer latch connector 138 may slide in through the outer latch piece 130 and interfit into the latch connector 136. The outer latch connector 138 allows a limited degree of sliding to occur with respect to the outer latch piece 130. In the present embodiment, the bias spring 140 will keep the outer latch piece 130 generally extended away from the upper shaft 134 but will allow a limited degree of movement in the direction of the upper shaft 134.

The upper shaft 134 may extend generally through the upper sub housing 102 and engage a washer stack 142 or other spring mechanism. The washers of the washer stack 142 may be spring washers, such as Belleville washers. In some embodiments, the entire region between a distal end 135 of the upper shaft 134 and the center connector 110 will be substantially filled with the washer stack 142. However, in other embodiments, such as the one shown in FIG. 1, it may not be necessary or desirable to completely fill this region with spring washers. In such case, a slack spring 144 may be provided and may be separated from the washer stack 142 by a washer 146. The washer 146 may be a flat washer that may or may not be attached to the upper shaft 134. As will be described in greater detail below, the washer stack 142 will be subject to compressive forces between the distal end 135 of the upper shaft 134 and the center connector 110. Because the slack spring 144 may have a much lower spring rate than the washer stack 142, a spring cage 148 may be utilized to limit the amount of compression received by the slack spring 144.

In some embodiments, the slack spring and/or washer stack 142 may bear directly against the center connector 110 when the device 100 is under tensile stress. However, in the present embodiment, the center connector 110 is provided with an adjustment sleeve 149 on the end connecting to the upper sub housing 102. Thus, in the present embodiment, the spring cage 148 or the slack spring 144 will bear against the adjustment sleeve 149. The adjustment sleeve 149 may be threaded or otherwise adjustably attached to the center connector 110. A set screw 150 may be utilized to prevent the sleeve 149 from coming out of adjustment. In some embodiments, the relative location of the washer stack 142 and the slack spring 144 may be reversed. Additionally, the adjustment sleeve 149 may be located at the distal end 135 of the upper shaft 134.

In operation, the jarring tool 100 may be used in a well bore or other downhole environment to free stuck tools or other equipment. The present exemplary embodiment is designed primarily for use with a slick line work string, but other embodiments are also contemplated as described below.

In one method of use, the jarring tool 100 will be included with the downhole work string, possibly near the bottom of the string. For example, the upper sub end 106 could connect to the uphole string while the lower sub end connects to a tool on location in the work string where a stickage is likely to result. In some respects, the tool 100 may be considered as a pair of sub ends 106, 122 having an extensible joint therebetween.

In the configuration shown in FIGS. 1A-1D, the jarring tool 100 is shown in a closed or latched position. At the point the line or tool becomes stuck within a well bore, the tool may be activated by supplying sufficient tensile forces to the sub ends 106, 122. As the sub ends 106, 122 are pulled apart, it will be appreciated that the lower shaft 120 will pull against the inner latch piece 128. The inner latch piece 128 and/or the lip 129 coming in contact with the outer latch piece 130 and/or lip 131 will pull the distal end 135 of the upper shaft 134 against the washer stack and/or slack spring 134.

The slack spring 144 may have a limited range of motion before the spring cage 148 will engage the washer 146 and/or the washer stack 142. It will be appreciated that the washer stack 142 may have an extremely high spring rate such that many hundreds or thousands of pounds of force are required to effectively overcome the force of the springs. In the present embodiment, the outer latch 130 is limited in its ability to disconnect from the inner latch 129 by the fixed release sleeve 132. However, when sufficient tensile strength has been applied to the tool 100, so as to displace the inner latch 128 and the outer latch 130 sufficiently through the release sleeve 132, the outer latch 130 will be free to slip free from the inner latch 128. The energy stored in the work line will rapidly displace the tool 100 in the direction of the upper sub end 136. However, the lower sub end 122, being attached to the stuck tool or line, will remain in place. The lower shaft 122 will then slide axially through the lower stop 118 until the lower shaft shoulder 126 impacts the inner shoulder 124 of the stop 118. It is this impact resulting from the line tension on the work string suddenly being released that will create a sufficient upward impact on the lower sub end 122 to free the stuck tool, line, or other device.

In some cases, it may be that a single jarring impact will not be sufficient to remove the stuck tool or line. It is also possible that once the tool or line has been freed, it will become stuck again. For this reason, the jarring tool 100 is resettable such that repeated impact jars may be provided in the wellbore. When a compressive force is applied to the tool after it is unlatched, the inner latch piece 128 will encounter the outer latch piece 130 within the release sleeve 132. However, as described, the release sleeve 132 does not provide sufficient clearance for the inner latch 128 and the outer latch 130 to reconnect. Therefore, in order to reset or relatch the tool 100, the outer latch piece 130 must be sufficiently displaced through the release sleeve 132 to allow sufficient clearance to relatch to the inner latch piece 128.

In the present embodiment, the outer latch piece 130 may be slidably attached to the outer latch connector 138. The bias spring 140 will normally keep the outer latch piece 130 within the release sleeve 132. However, when the bias spring forces overcome the outer latch piece 130 may displace toward the proximal end 114 of the lower sub housing 112 a sufficient amount to clear the release sleeve 132 and thereby relatch with the inner latch piece 128. At this point, the tool has been reset and may be activated to produce jarring forces again by reapplication of a tensile force. It will be appreciated that the spring rate of the bias spring 140 may be much lower than the spring rate of the washer stack 142. In this way, the amount of force necessary to reset or relatch the tool 100 will be very small in comparison to the amount of force required to activate the tool 100 by unlatching.

Referring now to FIGS. 2A-2E, another embodiment of the jarring tool of the present disclosure is shown. As with FIG. 1, FIGS. 2A-2E comprise a segmented illustration of the entire length of the tool 200. In the present disclosure, like numbered parts are similar from one drawing to the next, and thus it will be appreciated that the tool 200 bears many similarities to the tool 100. However, the present embodiment 200 illustrates an e-line version of the jarring tool of the present disclosure It can be seen that connected to the upper sub end 106 is a conductor housing 204. The conductor housing 204 may be another sub section that forms a part of the work string. An upper electrical connector 202 may cap off the upper housing 204 and provide for electrical connections to a conductor 206 that runs the length of the tool 200. The conductor 208 could be a single line or could be a braided or multiplexed line carrying a plurality of signals through the tool 200. A plug 208 may be provided according to the type of conductor being utilized. As can be seen with reference to FIGS. 2A-2E, a central passage 210 is provided through the entirety of the tool 200. A lower electrical connector 216 is provided for attachment to work line or tools that are below the jarring tool 200.

The jarring tool 200 operates in a manner that is similar to the operation of the jarring tool 100 described previously. However, since there may be locations within the passageway 210 that the conductor 206 could be pinched or otherwise damaged, protective sheathing may be provided as needed. In the present embodiment, a stainless steel shaft 214 is provided to prevent the conductor 206 from being damaged by the inner latch 128 and/or the outer latch 130. It will be appreciated that the length of the conductor 206 may need to change with the length of the tool 200 as the tool is examined for jarring or impacting. In the present embodiment, it can be seen that the conductor 206 may be coiled or otherwise stored within the conductor housing 204 such that the conductor is allowed to expand and contract with the tool 200.

It will be appreciated that various embodiments of the tools of the present disclosure can be utilized with a wide variety of drilling and downhole technology. Non-limiting examples include drill pipe, e-line, and slick line strings. The sub ends 106, 122 may be chosen according to the work string. Similarly, the overall size of the tools 100, 200 may be chosen based on well bore size and other requirements. Both the jarring force and the tension required to activate the tools may be adjusted and fine tuned based upon the number and type of spring washers in the stack 142 and the adjustment of the adjusting sleeve 149.

Referring now to FIGS. 3A-3D, a side cutaway view of an embodiment of a jarring tool with a reduced wear latch according to aspects of the present disclosure is shown. It will be appreciated that the jarring tool 300 bears some similarity in construction with regard to some components as the tool 100 previously described. However, it can be seen in FIG. 3A that the slack spring 144 and spring cage 148 are now nearer the distal end 104 of the upper housing 102. As before, a center washer 146 interposes the slack spring 144 and the washer stack 142. Both the slack spring 148 and the washer stack 142 remain concentrically confined around the upper shaft 134. In the present embodiment, the spring cage 148 abuts, and may be attached to, the distal end 135 of the upper shaft 134.

As with previous embodiments, the upper shaft 134 is permitted to slide through the center connector 110. The upper shaft 134 also connects with a latch piece as in previous embodiments. However, the latch of the jar 300 differs in some respects from those previously described. In the present embodiment, the upper shaft 134 is connected to an inner latch connector 302. This piece may join the upper shaft 134 to a latch stub 304. It can be seen that the latch stub 304 has a flare or lip 305 on a distal end. Retained by the latch stub 304 is an inner latch 306. A flare or lip 307 of the inner latch 306 may abut a flare or lip 305 on the latch stub 304.

In the present embodiment, the inner latch 306 is restrained by the upper shaft 134 against tensile forces by the inner latch connector 302 connecting to the latch stub 304. However, a limited degree of movement under compressive force may be allowed from the inner latch 306 sliding along the latch stub 304 toward the inner latch connector 302. A spring 308 may be provided that interpose the inner latch 306 and a lip 310 on the inner latch connector 302 in order to bias the inner latch 306 away from the upper shaft 134.

Figure 3A:
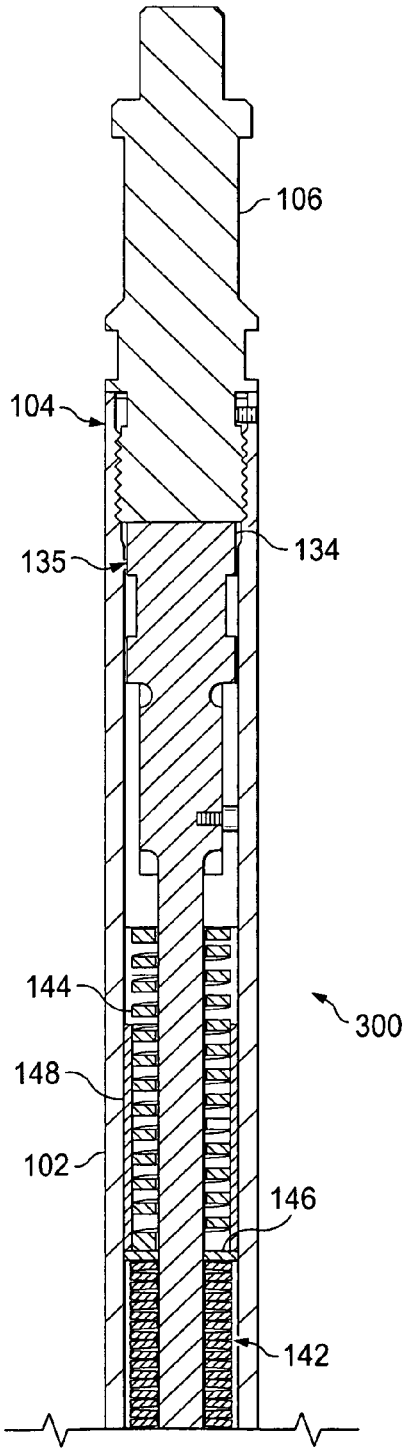
FIGS. 3A-3D taken together provide a side cutaway view of an embodiment of a jarring tool with reduced wear latch according to aspects of the present disclosure.
Figure 3B:
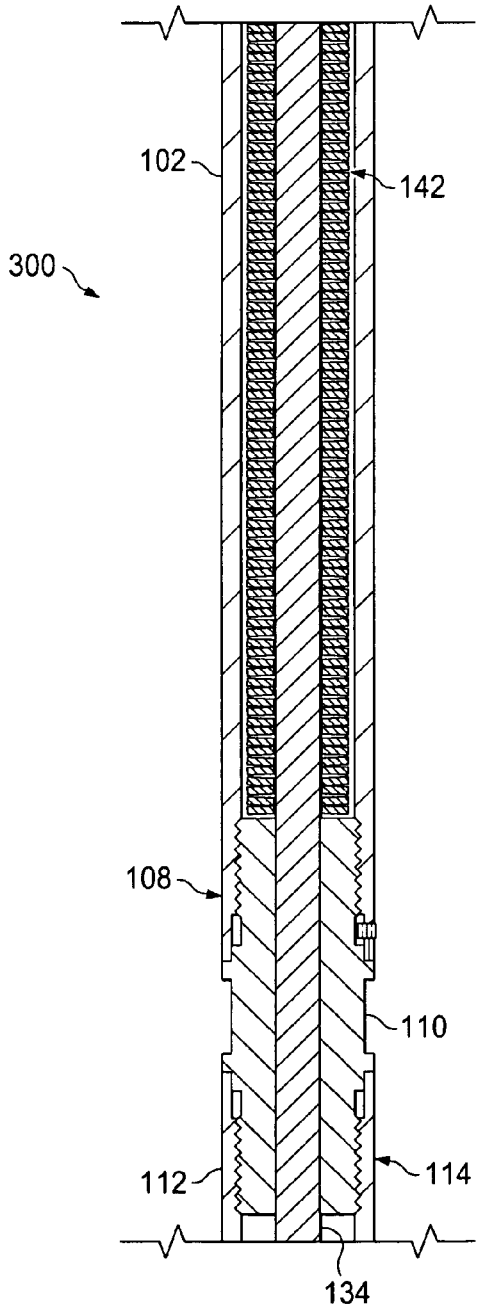
Figure 3C:
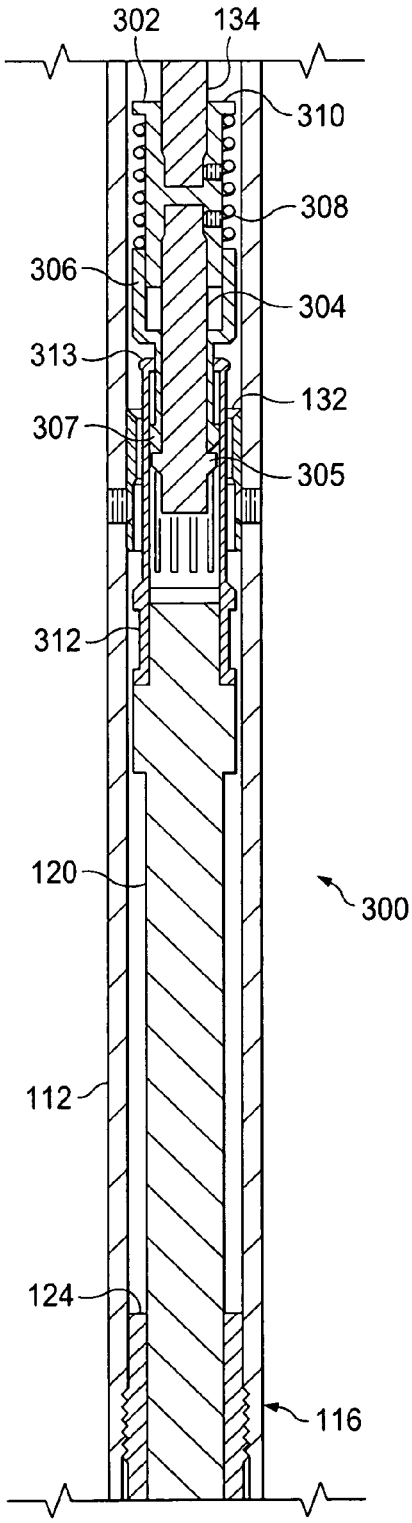
Figure 3D:
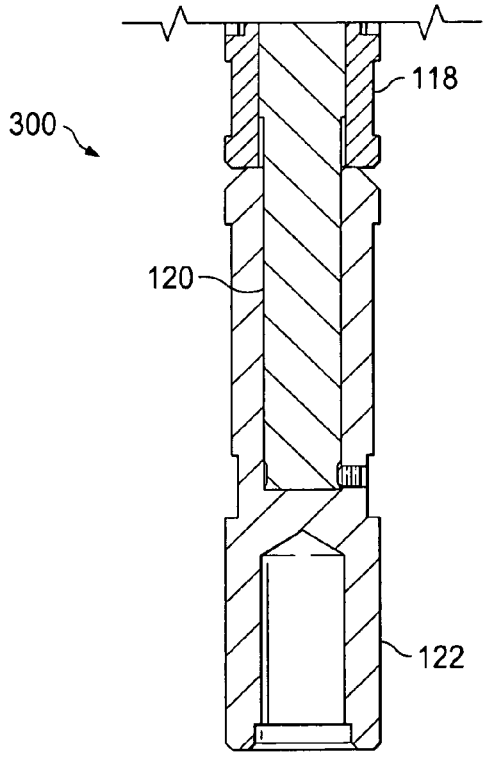
Figure 4A:
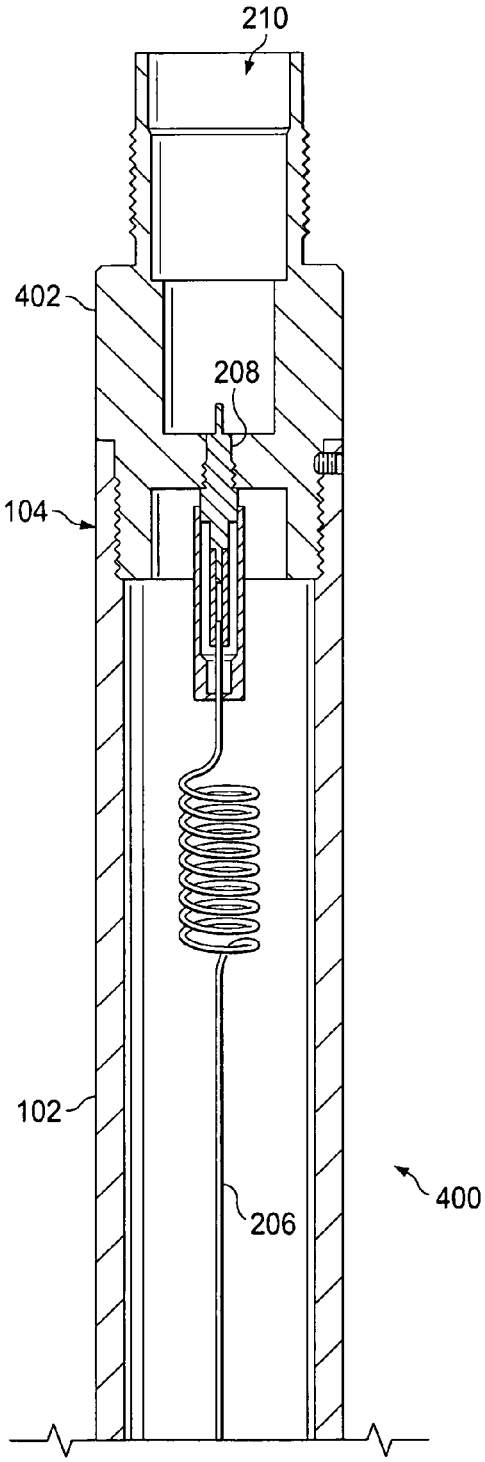
FIGS. 4A-4D taken together provide a side cutaway view of another embodiment of a jarring tool with reduced wear latch according to aspects of the present disclosure.
Figure 4B:
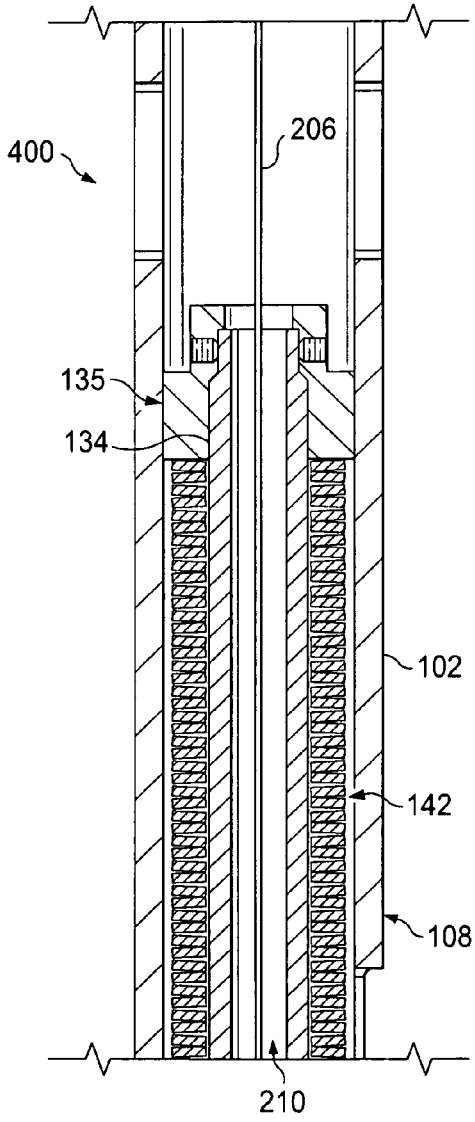
Figure 4C:
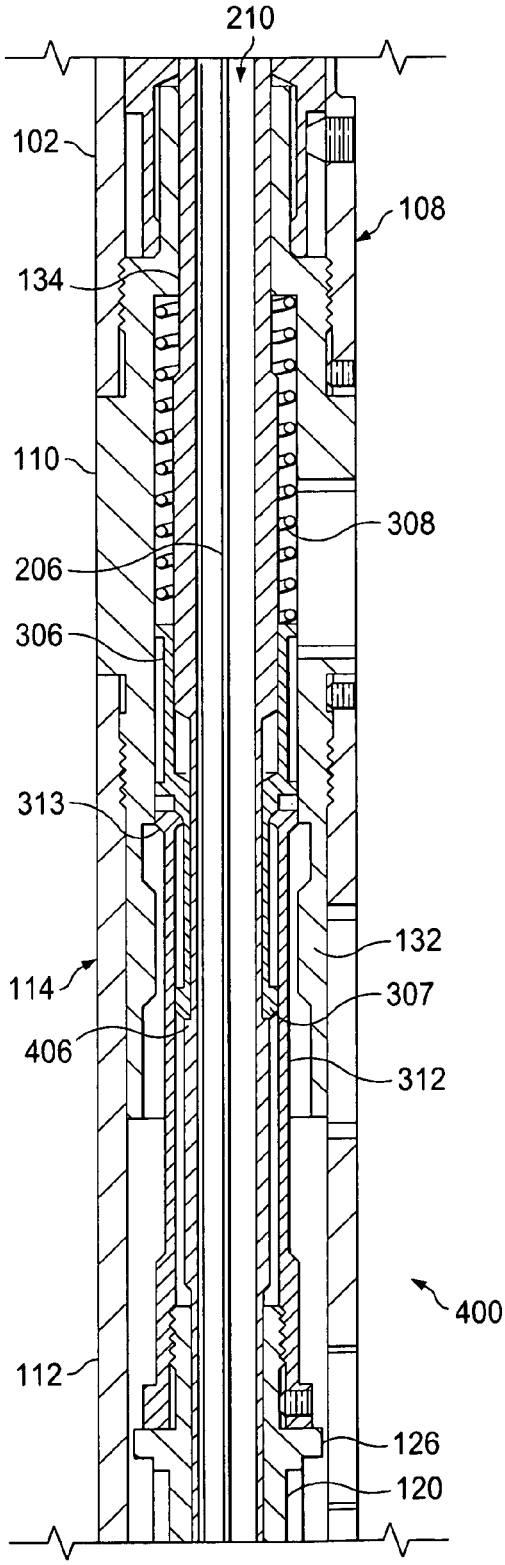
Figure 4D:
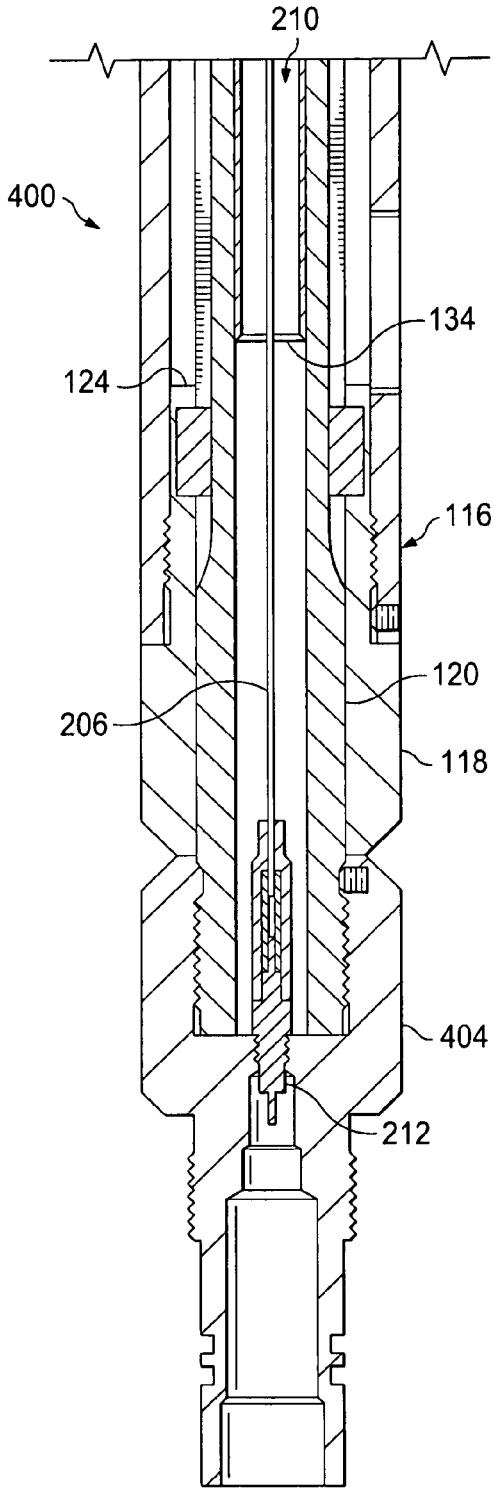

In the view of FIG. 3C, the tool 300 is shown in a latched configuration. In this embodiment, an outer latch 312 connects to the lower shaft 120. In the present embodiment, the outer latch 312 is a collet having a plurality of fingers with raised nubs 313.

In operation, as with previous embodiments, the tool 300 may be subject to tensile forces to activate, or unlatch, the tool. In the present embodiment, a tensile force pulling on the lower sub end 122 will translate to a pulling force on the lower shaft 120. This will cause the outer latch 312 to pull the inner latch 306. This force will result in the upper shaft 134 compressing the slack spring 144 and the washer stack 142. It will be appreciated that the slack spring 144 may compress much more easily than the washer stack 142, owing to differing spring rates. Thus, the amount of force required to activate or unlatch the tool 300 may be varied, based upon the relative amount of compression required of the slack spring 144 and the washer stack 142. The size of the spring cage 148, which does not compress, will also be a factor.

When the outer latch 312 has displaced the inner latch 306 a significant degree toward the distal end 116 of the lower housing 112, the flare or lip 307 and the nubs 313 will be pulled free of the release sleeve 132. The outer latch 312 will then be free to disengage from the inner latch 306. It will be appreciated that because the outer latch 312 disengages from the inner latch 306 and does not encounter any internal components of the tool 300 as it is withdrawn toward the distal end 116 of the lower housing 112, wear to the outer latch 312 will be reduced relative to an embodiment where the outer latch 312 may encounter the release sleeve 132 or another component.

In the present embodiment, the outer latch 312 is a collet and disengages from the inner latch 306 by expanding to become wider than the inner latch 306. Because the collet fingers will be under strain in this condition, they may be particularly susceptible from wear from impacts and other forces within the tool 300. Since the inner and outer latch 306, 312 do not separate until the outer latch 312 is drawn clear of the release sleeve 132 as the lower shaft 120 is drawn toward the distal end 116 of the lower sub housing 112, reduced wear is achieved. Because the inner latch 306 does not expand or contract in the latching or unlatching process, it may be withdrawn by the force of the slack spring 144 and/or the washer stack 142 through the release sleeve 132 at a high rate of speed without the possibility of damage or excessive wear.

Referring now to FIGS. 4A-4D, another embodiment of a jarring tool with a reduced wear latch according to aspects of the present disclosure is shown. The tool 400 is an e-line tool. As such, it is provided with the conductor 206 and plugs 208, 212. This embodiment differs from the previously discussed e-line embodiment in that the coiled conductor 206 is housed directly within the upper sub housing 102 rather than a separate conductor housing. Rather than slick line style sub ends, the tool 400 is provided with an electrical connector type sub end 402 attached to the distal end 104 of the upper sub housing 102. Similarly, a lower electrical connector 404 is provided attached to the lower shaft 120. A central passageway 210 is defined through the length of the tool 400 in order to pass the conductor 206.

In the present embodiment, the lower shaft 134 and the distal end 135 of the lower shaft are formed from separate pieces. The distal end 135 in the present embodiment abuts the concentrically arranged washer stack 142. In this manner, as in previous embodiments, the tensile forces on the upper shaft 134 will be transmitted to the washer stack 142 via the distal end 135 of the upper shaft. In the present embodiment, the inner latch 306 is concentrically arranged around a portion of the upper shaft 134. It can be seen that the upper shaft 134 may extend all the way through the center connector 110, the inner latch piece 306, the outer latch piece 312, and into the lower shaft 120. In this manner, the integrity of the center passageway 210 is maintained throughout the length of the tool 400, particularly through the area containing the moving latch pieces. As with previous embodiments, the coiled conductor 206 is allowed to expand with the expansion of the tool 400. However, actual expansion and contraction of the conductor 206 will generally occur in the upper housing 102.

In the present embodiment, the upper shaft 134 connects directly with the inner latch 306. Tensile forces may be transferred from the inner latch piece 306 to the upper shaft 134 by pressure between the inner latch piece 306 and a shoulder 406 of the upper shaft. When the lower shaft 120 pulls against the outer latch piece 312 engagement the nubs 313 with the lip 307, the upper shaft 134 will be forced to press against the washer stack 142. As before, when the nubs 313 and lip 307 have cleared the release sleeve 132, the latch piece 306, 312 will disengage and separate. It will be appreciated that in the present embodiment, as the tool expends to generate an impact force, the lower shaft 120 will slide along the outside of the upper shaft 134. In this manner, the integrity of the central passage 210 is maintained.

In the present embodiment, the inner latch piece 306 may again be forced through the restraining sleeve 132 by the outer latch piece 312 to accomplish relatching or resetting of the tool 400. In the present embodiment, the spring 308 interposes the center connector 110 and inner latch piece 306 to bias the inner latch piece 306 toward the distal end 116 of the lower sub housing 112. As with the embodiment of FIG. 3, because the outer latch piece 312 is allowed to freely recoil, reduced wear to this component and possibly others will result.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A jarring tool comprising:

an extensible joint connecting upper and lower sub ends, the joint comprising a first inner latch piece connected to the lower sub end, and a second outer latch piece connected to the upper sub end, and a stationary restraining collar restricting the inner and outer latch pieces from unlatching;

wherein the joint, under tensile force, unlatches into an unlatched position by the inner latch piece pulling the outer latch piece through the restraining collar into a position where the inner and outer latch pieces are free to unlatch.

2. The jarring tool of claim 1, wherein the joint relatches into a latched position by the inner latch piece pushing the outer latch piece back through the restraining collar into a position where the inner and outer latch pieces are free to relatch.

3. The jarring tool of claim 1, wherein outer latch piece comprises a collet having a plurality of fingers with nubs along distal ends that contact a lip on the inner latch piece when being moved into the latched or unlatch positions through the restraining collar.

4. A jarring tool comprising:

an extensible joint connecting upper and lower sub ends, the joint comprising a first inner latch piece connected to the upper sub end, and second outer latch piece connected to the lower sub end, and a stationary restraining collar;

wherein the joint, in a latched position, has the outer latch piece latched to the inner latch piece and the inner and outer latch pieces restrained from unlatching by the restraining collar;

wherein the joint, under tensile force, unlatches into an unlatched position by the outer latch piece pulling the inner latch piece through the restraining collar into a position where the inner and outer latch pieces are free to separate; and wherein an impact force is generated from the tensile force when the joint unlatches and reaches a maximum extension.

5. The tool of claim 4, wherein the joint relatches into a latched position by the outer latch piece pushing the inner latch piece back through the restraining collar into a position where the inner and outer latch pieces are free to relatch.

6. The tool of claim 4, wherein the outer latch piece comprises a collet device.

7. The tool of claim 4, wherein outer latch piece comprises a collet having a plurality of fingers with nubs along distal ends that contact a lip on the inner latch piece when being moved into the latched or unlatch positions through the restraining collar.

8. The tool of claim 4, wherein the outer latch piece is biased toward the inner latch piece by a coil spring.

9. The tool of claim 4, further comprising:

a lower shaft interconnecting the inner latch piece to the lower sub end; and a lower stop slidably receiving the lower shaft wherein the impact force at maximum extension results from contact between the lower shaft and the lower stop.

10. The tool of claim 4, further comprising:

an upper sub housing connected to the upper sub end;

a lower sub housing;

a center connector connecting the upper sub housing and the lower sub housing;

an upper shaft slidably received through the center connector and connecting to the upper latch piece; and a plurality of springs biasing the upper shaft away from the center connector.

11. The tool of claim 10, wherein the restraining collar is attached in a fixed relationship to the lower sub housing.

12. The tool of claim 10, wherein the plurality of springs comprise a plurality of spring washers.

13. The tool of claim 12, further comprising a coil spring abutting the plurality of spring washers and a spring cage partially surrounding the coil spring.

14. The tool of claim 4, further comprising:

a central passage defined through the extensible joint and through the upper and lower sub ends; and an electrical conductor carried within the central passage.

15. A jarring tool comprising:

an upper housing and a lower housing joined at proximal ends by a center connector;

a lower stop affixed to a distal end of the lower housing;

an upper shaft slidingly engaged through the center connector from the upper housing to the lower housing and connecting to an inner latch piece in the lower housing, the upper shaft being biased against movement through the center connector, in the direction of the distal end of the lower housing, by a plurality of springs in the upper housing; and a lower shaft connected to an outer latch in the lower housing and slidably engaged through the lower stop; and a release sleeve affixed within the lower housing;

wherein the inner and outer latch pieces are restrained from unlatching by the release sleeve until a tensile force acting on the lower shaft pulls the inner and outer latch pieces free of the release sleeve toward the distal end of the lower housing.

16. The jarring tool of claim 15, wherein the inner and outer latch pieces relatch when pushed through the release sleeve toward the upper housing by a compressive force on the lower shaft.

17. The jarring tool of claim 16, wherein a coil spring interconnects the upper shaft and the inner latch piece and biases the inner latch piece away from the upper shaft, the force of the spring being overcome by compressive forces to allow relatching of the inner and outer latch pieces.

18. The jarring tool of claim 15, further comprising upper and lower sub connectors attached to the distal end of the upper housing and the lower shaft, respectively.

19. The jarring tool of claim 15, wherein the lower shaft has a shoulder that contacts the lower stop when the tool is at a maximum extension resulting in a tensile jarring force along a length of the tool.

20. The jarring tool of claim 15, wherein a conductor path is defined through the upper and lower shafts and the inner and outer latch pieces.

* * * * *